US011788403B2

(12) United States Patent
Hawthorn et al.

(10) Patent No.: US 11,788,403 B2
(45) Date of Patent: Oct. 17, 2023

(54) DETECTION OF A BARRIER BEHIND A WELLBORE CASING

(71) Applicant: Baker HughesOilfield Operations LLC, Houston, TX (US)

(72) Inventors: Andrew Hawthorn, Houston, TX (US); Knut Inge Dahlberg, Houston, TX (US)

(73) Assignee: Baker Hughes Oilfield Operations LLC

( * ) Notice: Subject to any disclaimer, the term of this patent is extended or adjusted under 35 U.S.C. 154(b) by 243 days.

(21) Appl. No.: 16/991,497

(22) Filed: Aug. 12, 2020

(65) Prior Publication Data

US 2021/0047912 A1 Feb. 18, 2021

Related U.S. Application Data

(60) Provisional application No. 62/888,063, filed on Aug. 16, 2019.

(51) Int. Cl.

| | |
|---|---|
| ***E21B 47/005*** | (2012.01) |
| ***E21B 33/14*** | (2006.01) |
| ***E21B 47/10*** | (2012.01) |
| ***E21B 47/16*** | (2006.01) |
| ***E21B 47/06*** | (2012.01) |
| *E21B 33/12* | (2006.01) |

(52) U.S. Cl.

CPC ..... *E21B 47/005* (2020.05); *E21B 33/14* (2013.01); *E21B 47/06* (2013.01); *E21B 47/10* (2013.01); *E21B 47/16* (2013.01); *E21B 33/12* (2013.01)

(58) Field of Classification Search

CPC combination set(s) only.
See application file for complete search history.

(56) References Cited

U.S. PATENT DOCUMENTS

| | | | |
|---|---|---|---|
| 6,382,319 | B1 | 5/2002 | Hill, Jr. et al. |
| 2003/0213591 | A1 | 11/2003 | Kuchuk et al. |
| 2009/0101340 | A1 | 4/2009 | Jeffryes |
| 2011/0061862 | A1 | 3/2011 | Loretz et al. |
| 2014/0153369 | A1 | 6/2014 | Van Zelm |
| 2014/0338896 | A1 | 11/2014 | McGarian et al. |
| 2016/0215612 | A1* | 7/2016 | Morrow ..... E21B 47/13 |

(Continued)

FOREIGN PATENT DOCUMENTS

| | | | |
|---|---|---|---|
| WO | 2004013461 | A1 | 2/2004 |
| WO | 2019199828 | A1 | 10/2019 |

OTHER PUBLICATIONS

Written Opinion of the International Searching Authority in international application PCT/US2020/046355 dated Oct. 20, 2020, 12 pages.

*Primary Examiner* — Sean D Andrish
(74) *Attorney, Agent, or Firm* — Jonathan Pierce; Pierre Campanac; Porter Hedges LLP

(57) ABSTRACT

The detection of a barrier behind a wellbore casing involves the injection of a fluid into the wellbore casing or the pumping of a fluid from the wellbore casing, and the monitoring in real-time of the fluid properties in two downhole fluid volumes separated by a packer. A detection system utilizes a pipe string equipped with a telemetry that is capable of transmitting fluid property data to a surface monitor while the pipe string remains in the wellbore casing, and preferably while the packer remains set against the wellbore casing.

14 Claims, 3 Drawing Sheets

(56) References Cited

U.S. PATENT DOCUMENTS

| | | | | |
|---|---|---|---|---|
| 2017/0268320 | A1* | 9/2017 | Angman | E21B 23/10 |
| 2018/0058209 | A1 | 3/2018 | Song et al. | |
| 2018/0179886 | A1 | 6/2018 | Espe et al. | |
| 2019/0153849 | A1* | 5/2019 | Kent | E21B 47/18 |

* cited by examiner

DETECTION OF A BARRIER BEHIND A WELLBORE CASING

BACKGROUND

This disclosure relates generally to methods and apparatus for detecting a barrier behind a wellbore casing. This disclosure relates more particularly to the detection of the barrier that involves the injection of a fluid into or the pumping of the fluid from the wellbore casing and the monitoring in real-time of the properties of two downhole fluid volumes separated by a packer.

A wellbore casing is usually lowered into a wellbore that has been drilled into the ground. Cement is then squeezed around the wellbore casing. When the cement has cured, the wellbore casing is supposed to hold differential pressure and provide a barrier to any fluid flow behind the wellbore casing. It is often important to verify that the cement indeed holds pressure and provides a flow barrier.

The ability of the cement to hold pressure and provide a flow barrier can be verified using the known method of cement-bond logging with an acoustic tool. For doing so, any pipe string present in the wellbore must be retrieved so that the acoustic tool can be run in the wellbore. The acoustic tool records the propagation of waves in and behind the wellbore casing. The integrity of the cement is inferred from the characteristics of the propagation of waves. The interpretation of the data recorded by the acoustic tool is sometimes ambiguous.

Alternatively, the ability of the cement to hold pressure and provide a flow barrier can be verified using the injection of a fluid into the wellbore casing and the recording of the properties of two downhole fluid volumes separated by a packer. In operation, the packer is conveyed on a pipe string to a given location between two holes made through the wellbore casing. A fluid is pumped into the wellbore through a bore in the pipe string. Data of the downhole pressure in a fluid volume above the packer and of the downhole pressure in a fluid volume below the packer are recorded in a memory coupled to pressure sensors. The pipe string, packer, and memory are then retrieved above the ground where the recorded data can be analyzed to verify the ability of the cement located near the given location to hold pressure and provide a flow barrier. This operation can then be repeated for another given location between two other holes made through the wellbore casing. Accordingly, verifying that the cement can hold pressure and provide a flow barrier at several locations involves multiple trips of the pipe string and is time-consuming.

Thus, there is a continuing need in the art for methods and apparatus for detecting a barrier behind a wellbore casing that may not require the tripping of a pipe string.

BRIEF SUMMARY OF THE DISCLOSURE

The disclosure describes a system, which may be used in a wellbore casing to indicate a presence or an absence of a barrier.

The system may comprise a pipe string.

The system may comprise a packer. The packer may be coupled to the pipe string. The packer may be resettable.

The system may comprise a pump. The pump may be configured to inject fluid into or draw fluid from the wellbore casing selectively through a bore in the pipe string, through an annulus between the pipe string and the wellbore casing, or alternately through the bore and the annulus.

The system may comprise a first sensor system. The first sensor system may be coupled to the pipe string. The first sensor system may be configured to measure a fluid property of a first fluid volume located in the wellbore casing below the packer after the packer is set against the wellbore casing. In some embodiments, the first fluid sensor system may comprise a fluid pressure sensor. In some embodiments, the first fluid sensor system may alternatively or additionally comprise a flow rate sensor. For example, the first fluid sensor system may comprise a first sensor configured to measure fluid pressure in the bore of the pipe string and a second sensor configured to measure fluid pressure in the annulus of the wellbore casing. The first sensor and the second sensor may both be coupled to the pipe string at a first longitudinal location below the packer.

The system may comprise a second fluid sensor system. The second sensor system may be coupled to the pipe string. The second sensor system may be configured to measure a fluid property of a second fluid volume located in the wellbore casing above the packer after the packer is set against the wellbore casing. In some embodiments, the second fluid sensor system may comprise a fluid pressure sensor. In some embodiments, the second fluid sensor system may alternatively or additionally comprise a flow rate sensor. For example, the second fluid sensor system may comprise a third sensor configured to measure fluid pressure in the annulus of the wellbore casing. The third sensor may be coupled to the pipe string at a second longitudinal location above the packer.

The system may comprise a telemetry. The telemetry may be capable of transmitting fluid property data measured with the first sensor system and with the second sensor system to a surface monitor while the pipe string remains in the wellbore casing. The telemetry may additionally be capable of transmitting the fluid property data while the packer remains set against the wellbore casing. In some embodiments, the telemetry may comprise a transmitter. The transmitter may be configured to emit an acoustic signal that encodes the fluid property data in a wall of the pipe string. The emitted acoustic signal may be capable of traveling along the pipe string across the packer. In some embodiments, the telemetry may comprise a section of wired drill pipe. The section of wired drill pipe may be disposed at least across the packer. The section of wired drill pipe may be configured to conduct an electrical signal that encodes the fluid property data.

The surface monitor may be programmed to receive the fluid property data transmitted with the telemetry. The surface monitor may be programmed to indicate a presence or an absence of a barrier between the first fluid volume and the second fluid volume based on the received data.

The system may comprise a downhole tool. The downhole tool may be coupled to the pipe string. The downhole tool may be configured to cut or perforate the wellbore casing.

Furthermore, the disclosure describes a method for indicating a presence or an absence of a barrier in a wellbore casing.

The method may comprise providing a pipe string in the wellbore casing. The wellbore casing may include a first hole and a second hole offset from the first hole. For example, the method may comprise cutting or perforating the wellbore casing with a downhole tool coupled to the pipe string while the pipe string remains in the wellbore casing. In some embodiments, an outer casing may surround the wellbore casing. Cement may be disposed between the wellbore casing and the outer casing.

The method may comprise setting a packer coupled to the pipe string against the wellbore casing. The packer may be set between the first hole and the second hole.

The method may comprise injecting fluid into or pumping fluid from the wellbore casing with a pump. For example, the injecting of the fluid into the wellbore casing may be performed through a bore in the pipe string, through an annulus between the pipe string and the wellbore casing, or alternately through the bore and through the annulus. Similarly, the pumping of the fluid from the wellbore casing may be performed through a bore in the pipe string, through an annulus between the pipe string and the wellbore casing, or alternately through the bore and through the annulus.

The method may comprise measuring a fluid property of a first fluid volume located in the wellbore casing below the packer after the packer is set against the wellbore casing. The measuring may be performed with a first sensor system coupled to the pipe string. In some embodiments, the measuring of the fluid property in the first fluid volume may be performed with a pressure sensor. In some embodiments, the measuring of the fluid property in the first fluid volume may alternatively or additionally be performed with a flow rate sensor. For example, the measuring of the fluid property in the first fluid volume may comprise measuring fluid pressure in the bore of the pipe string with a first sensor and measuring fluid pressure in the annulus of the wellbore casing with a second sensor. The first sensor and the second sensor may both be coupled to the pipe string at a first longitudinal location below the packer.

The method may comprise measuring a fluid property of a second fluid volume located in the wellbore casing above the packer after the packer is set against the wellbore casing. The measuring may be performed with a second fluid sensor system coupled to the pipe string. In some embodiments, the measuring of the fluid property in the second fluid volume may be performed with a pressure sensor. In some embodiments, the measuring of the fluid property in the second fluid volume may alternatively or additionally be performed with a flow rate sensor. For example, measuring the fluid property in the second fluid volume may comprise measuring fluid pressure in the annulus of the wellbore casing with a thirst sensor. The third sensor may be coupled to the pipe string at a second longitudinal location above the packer.

The method may comprise transmitting fluid property data measured with the first sensor system and with the second sensor system to a surface monitor while the pipe string remains in the wellbore casing. The transmitting may be performed with a telemetry. In some embodiments, the method may comprise emitting an acoustic signal that encodes the fluid property data in a wall of the pipe with a transmitter. The acoustic signal may be capable of traveling along the pipe string and across the packer. In some embodiments, the method may comprise conducting an electrical signal that encodes the fluid property data through a section of wired drill pipe. The section of wired drill pipe may be disposed across the packer.

The method may comprise executing a program on the surface monitor. The execution of the program may cause the surface monitor to receive the fluid property data transmitted with the telemetry. The execution of the program may cause the surface monitor to indicate a presence or an absence of a barrier between the first fluid volume and the second fluid volume based on the received data. The method may comprise adjusting a setting force on the packer while the pipe string remains in the wellbore casing upon the surface monitor indicating the absence of a barrier between the first fluid volume and the second fluid volume. The method may comprise injecting cement through a bore in the pipe string while the pipe string remains in the wellbore casing upon the surface monitor indicating the absence of a barrier between the first fluid volume and the second fluid volume.

The method may comprise resetting the packer against the wellbore casing while the pipe string remains in the wellbore casing.

BRIEF DESCRIPTION OF THE DRAWINGS

For a more detailed description of the embodiments of the disclosure, reference will now be made to the accompanying drawings, wherein.

DETAILED DESCRIPTION

The detection of a barrier behind a wellbore casing involves the injection of a fluid into or the pumping of the fluid from the wellbore casing and the monitoring in real-time of the fluid properties in two downhole fluid volumes separated by a packer. A detection system utilizes a pipe string equipped with a telemetry that is capable of transmitting fluid property data to a surface monitor while the pipe string remains in the wellbore casing, and preferably while the packer remains set against the wellbore casing.

Figure 1:
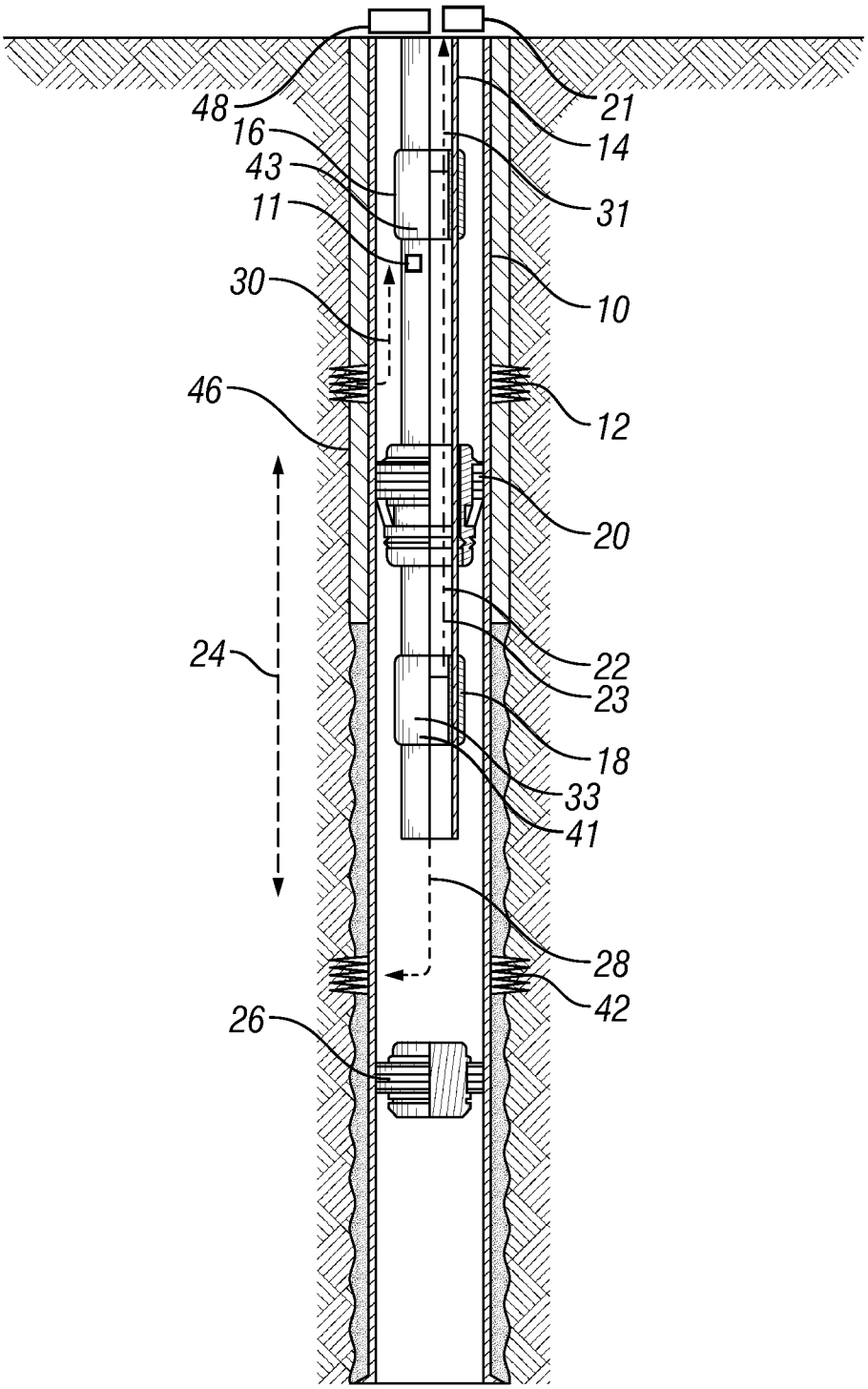
FIG. 1 is a schematic view of a system that is used in a wellbore casing to indicate a presence or an absence of a barrier.
Figure 2:
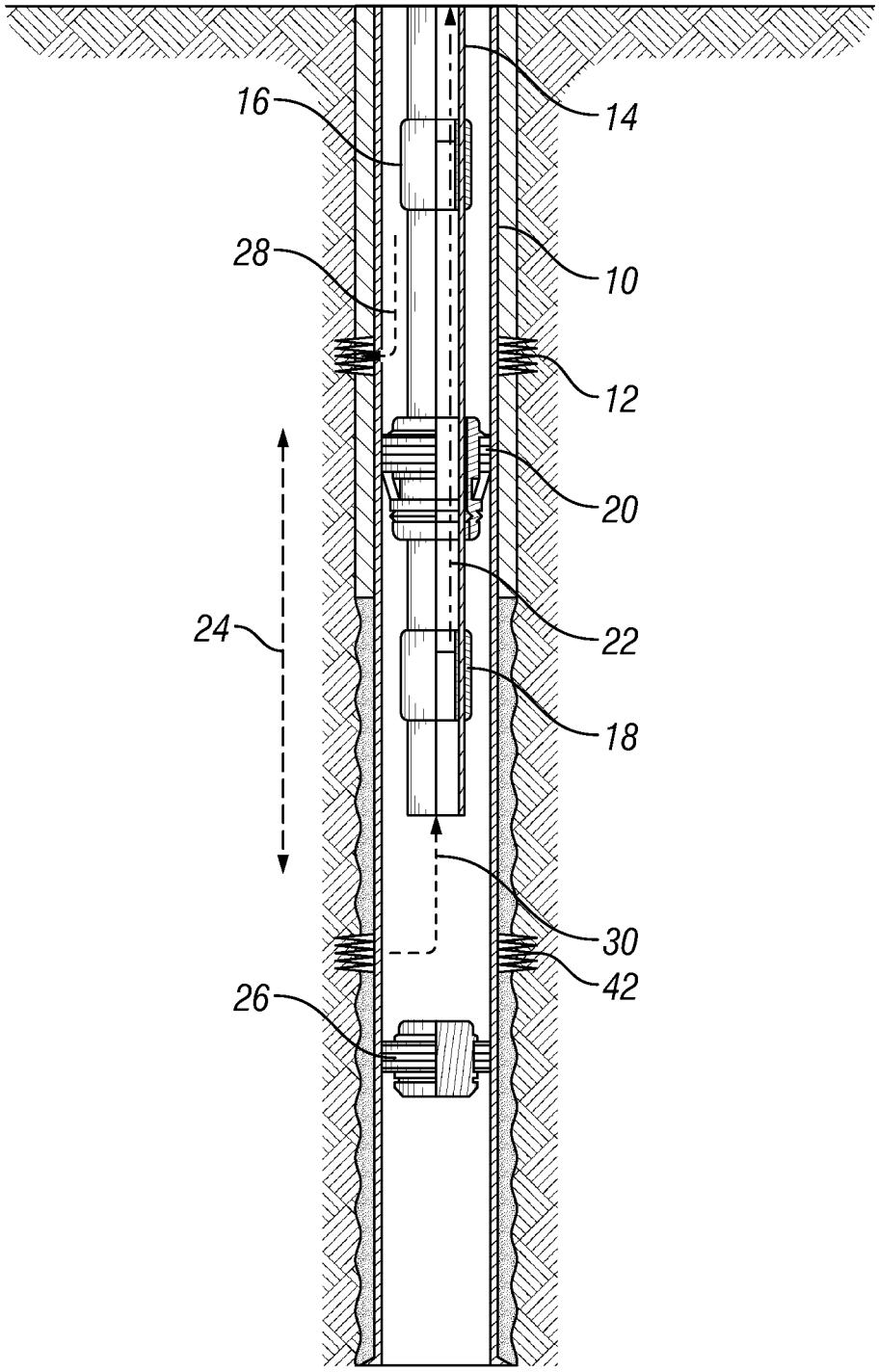
FIG. 2 is a schematic view of another system that is used in a wellbore casing to indicate a presence or an absence of a barrier.

Referring initially to FIGS. 1 and 2, a pipe string 14 is shown provided in the wellbore casing 10. The wellbore casing 10 includes a first hole 12 or set of holes and a second hole 42 or set of holes. The second hole 42 is offset from the first hole 12 by an interval 24. The first hole 12 and/or the second hole 42 may have been created through the wellbore casing 10 with a downhole tool 11 configured for perforating casing or for cutting casing. For example, the downhole tool 11 may be coupled to the pipe string 14, above or below a packer 20, and the first hole 12 and/or the second hole 42 may have been created while the pipe string 14 remains in the wellbore casing 10.

The packer 20 is shown coupled to the pipe string 14. The packer 20 is set against the wellbore casing 10 between the first hole 12 and a second hole 42. The packer 20 is preferably a compression packer that is set by applying a downward setting force on the packer 20 with the pipe string 14. However, the packer 20 may be of another type, such as an inflatable packer. Preferably, the packer 20 can be unset and reset multiple times and in different longitudinal positions along the wellbore casing 10, for example between different pairs of holes created apart through the wellbore casing 10.

For indicating a presence or an absence of a barrier between a first fluid volume located in the wellbore casing 10 below the packer 20 and a second fluid volume located in the wellbore casing above the packer 20 after the packer 20 is set, pressurized fluid is injected into the wellbore casing 10 with a pump 48. Alternatively, fluid is pumped from the wellbore casing 10 with the pump 48. Usually, the presence or absence of barrier between the first and second volumes is indicative of a presence or an absence of barrier in the interval 24 behind the wellbore casing 10. However, in some cases, the presence or absence of barrier between the first and second volumes can be indicative of leakage across the packer 20, for example. For the sake of simplicity, the description that follows in this paragraph assumes that there is no leakage across the packer 20. In the example illustrated in FIG. 1, the pressurized fluid is injected through a bore in the pipe string 14, as suggested by arrow 28, which represents the flow of the pressurized fluid out of the bore of the pipe string into the wellbore casing. In the absence of a flow barrier in the interval 24, the pressurized fluid may leave the wellbore casing 10 through the second hole 42, and flow up behind the wellbore casing 10 along the interval 24. The pressurized fluid may reenter the wellbore casing 10 through the first hole 12, as suggested by arrow 30, which represents the flow of the pressurized fluid out of the interval 24 behind the wellbore casing 10 into the wellbore casing 10. In the example illustrated in FIG. 2, the pressurized fluid is injected through an annulus between the pipe string 14 and the wellbore casing 10. In the absence of a flow barrier in the interval 24, the pressurized fluid may leave the wellbore casing 10 through the first hole 12, as suggested by arrow 28, which represents the flow of the pressurized fluid out of the annulus into the interval 24. The pressurized fluid may flow down behind the wellbore casing 10 along the interval 24. The pressurized fluid may reenter the wellbore casing 10 through the second hole 42, as suggested by arrow 30, which represents the flow of the pressurized fluid out of the interval 24 behind the wellbore casing 10 into the wellbore casing 10 and into the bore of the pipe string 14. While the presence or the absence of a barrier in the interval 24 can be indicated only using a top-down flow direction as shown in FIG. 1, or only using a bottom-up flow direction as shown in FIG. 2, it may be preferable to use both top-down and bottom-up flow directions sequentially to avoid false detection of the presence of a barrier caused by floating debris forming a barrier in only one flow direction. As mentioned before, fluid may alternatively or additionally be pumped from the wellbore casing 10.

A first sensor system 18 is coupled to the pipe string 14. The first sensor system 18 includes one or more sensors configured to measure a fluid property (e.g., pressure, temperature, flow rate) in a first fluid volume located in the wellbore casing 10 below the packer 20 after the packer 20 is set against the wellbore casing 10. The first fluid volume may extend inside the bore of the pipe string 14. The first sensor system 18 can include one or more of annular pressure sensors, pipe bore pressure sensors, annular temperature sensors, pipe bore temperature sensors, annular flow rate sensors, pipe bore flow rate sensors, or any combination of such sensors. In a preferred embodiment, the first sensor system 18 comprises a first sensor 33 configured to measure fluid pressure in the bore of the pipe string 14 and a second sensor 41 configured to measure fluid pressure in the annulus of the wellbore casing 10. The first sensor and the second sensor are coupled to the pipe string 14 at a first longitudinal location below the packer 20. However, the first sensor system 18 may comprise sensors distributed along the length of the pipe string 14, and thus located at one of several longitudinal positions.

A second sensor system 16 is coupled to the pipe string 14. The second sensor system 16 includes one or more sensors configured to measure a fluid property (e.g., pressure, temperature, flow rate) in a second fluid volume located in the wellbore casing 10 above the packer 20 after the packer 20 is set against the wellbore casing 10. The second sensor system 16 can include one or more of annular pressure sensors, annular temperature sensors, annular flow rate sensors, or any combination of such sensors. In a preferred embodiment, the second sensor system 16 comprises a third sensor 43 configured to measure fluid pressure in the annulus of the wellbore casing 10. The third sensor is coupled to the pipe string 14 at a second longitudinal location above the packer 20. However, the second sensor system 16 may comprise sensors distributed along the length of the pipe string 14 above the packer 20, and thus located at one of several longitudinal positions above the packer 20.

A telemetry 22 is used for transmitting fluid property data measured with the first sensor system 18 and with the second sensor system 16 to a surface monitor 21 while the pipe string 14 remains in the wellbore casing 10. In some embodiments, the telemetry includes an acoustic telemetry that utilizes the propagation of acoustic signals along the pipe string 14 and across the packer 20. Such acoustic telemetry can include a first acoustic transmitter, preferably an inline acoustic transmitter 23, coupled to the first sensor system 18. The first acoustic transmitter emits a first acoustic signal that encodes the fluid property data measured by the first sensor system 18. The acoustic telemetry can further include a first acoustic receiver, and a second acoustic transmitter, preferably an inline acoustic transmitter 31, coupled to the second sensor system 16 and the first acoustic receiver. The first acoustic receiver measures the first acoustic signal emitted with the first acoustic transmitter, and the first acoustic signal is decoded to recover the fluid property data measured by the first sensor system 18. The second acoustic transmitter emits a second acoustic signal that encodes the fluid property data measured by the first sensor system 18 and by the second sensor system 16. The second acoustic signal may be measured and decoded by the surface monitor 21. Alternatively, the telemetry 22 may include additional repeaters, optionally coupled to additional sensors, that measure and reemit acoustic signals along the pipe string 14. Also, the direction of propagation of signals can be inverted. For example, the second acoustic transmitter can emit another acoustic signal that encodes the fluid property data measured by the second sensor system 16. The acoustic telemetry can further include another acoustic receiver, coupled to the first acoustic transmitter. The other acoustic receiver measures the other acoustic signal emitted with the second acoustic transmitter, and the other acoustic signal is decoded to recover the fluid property data measured by the second sensor system 16. Then, the first acoustic transmitter emits an acoustic signal that encodes the fluid property data measured by the first sensor system 18 and by the second sensor system 16. In some embodiments, the telemetry includes a wired drill pipe telemetry. Such a wired drill pipe telemetry may work essentially similarly to the acoustic telemetry with the conduction of electrical signal along wires replacing the propagation of acoustic signal along the pipe. In yet other embodiments, the telemetry may include both acoustic telemetry and wired drill pipe telemetry. In either case, the telemetry is capable of transmitting the fluid property data while the packer 20 remains set against the wellbore casing 10.

The telemetry 22 can optionally be used for other purposes. For example, a tension/compression in the pipe string 14 (also referred to as the downhole weight) can be measured downhole, such as above the packer 20. The tension/compression in the pipe string 14 measured downhole can be sent to the surface monitor. The tension/compression in the pipe string 14 measured downhole may be used by the surface monitor with a tension/compression in the pipe string 14 measured at surface for the confirmation of the setting of the packer 20, for example. Also, the telemetry 22 is preferably bi-directional. Accordingly, the surface monitor can send commands or signals to activate (e.g., set or unset) the packer 20, and/or to cause the downhole tool to perforate or cut the wellbore casing 10.

The system can optionally comprise a plug 26 that seals the wellbore casing 10 below the packer 20. Similarly, the system can optionally comprise a blowout preventer (not shown) that seals the annulus between the pipe string 14 and the wellbore casing 10 above the packer 20. For example, the blow out preventer may be disposed close to the surface. The plug 26 and/or the blow out preventer can be used to contain the flow of the pressurized fluid injected or drawn with the pump in a selected portion of the wellbore casing 10, and thus, may facilitate the measurement of fluid pressure signals with the first sensor system 18 and/or the second sensor system 16.

Figure 3:
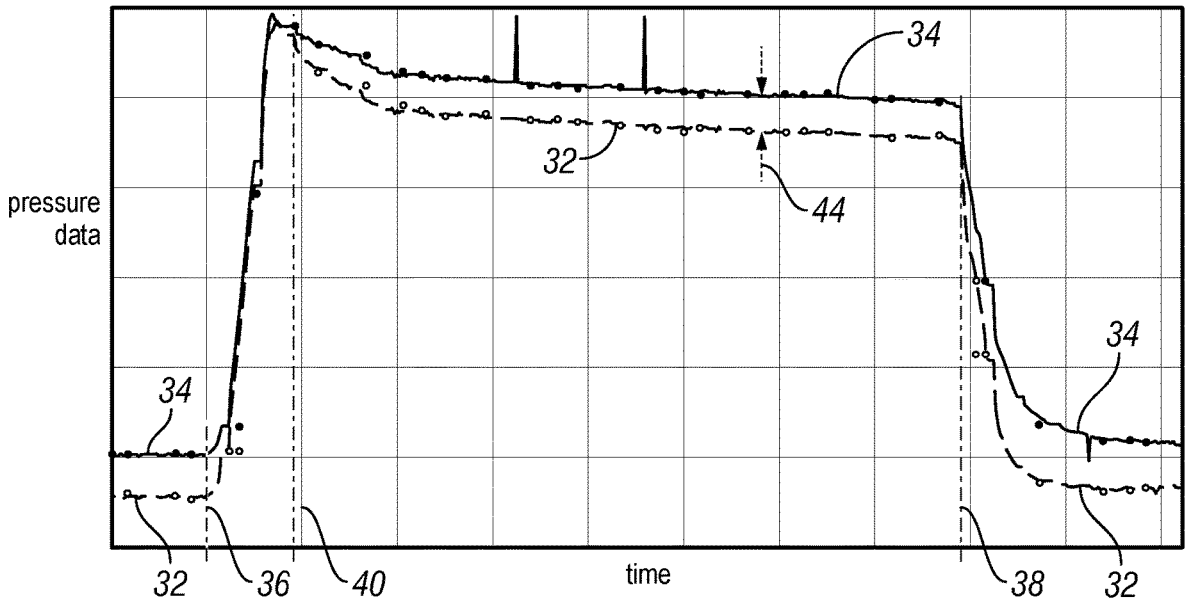
FIG. 3 is a graph of pressure data transmitted by a telemetry of the system shown in FIG. 2.

In operation, the system is provided in the wellbore casing 10 with the packer 20 unset. The downhole tool may optionally be used to cut or perforate the first hole 12 and/or the second hole 42, or the first hole 12 and/or the second hole 42 may already exist. The packer 20 is set between the first hole 12 and the second hole 42. Fluid property data (e.g., pressure, temperature, flow rate) that are measured by the first sensor system 18 and the second sensor system 16 in response to the injection of pressurized fluid into the wellbore casing 10 or the pumping of fluid from the wellbore casing 10 are transmitted to the surface monitor by the telemetry 22 while the pipe string 14 remains in the wellbore casing 10 and while the packer 20 is set. A program executed on the surface monitor causes the surface monitor to receive the fluid property data transmitted with the telemetry. An example of such data is illustrated in FIG. 3. The program then analyzes the fluid property data for indicating the presence or the absence of a barrier between a first fluid volume located in the wellbore casing 10 below the packer 20 and a second fluid volume located in the wellbore casing above the packer 20.

As mentioned before, the absence of a barrier between the first and second fluid volumes can be caused by a leakage across the packer 20. For ruling out this eventuality, a setting force applied on the packer 20 by the pipe string 14 can be adjusted (e.g., increased) while the pipe string 14 remains in the wellbore casing. The adjustment of the setting force may eliminate the leakage across the packer 20. The injection and/or draw of pressurized fluid may then continue after the setting force has been adjusted. In some cases, the fluid property data received after the setting force has been adjusted may indicate a presence of a fluid barrier, suggesting that the absence of a barrier between the first and second fluid volumes was initially caused by a leakage across the packer 20. In other cases, the fluid property data received after the setting force has been adjusted may still indicate an absence of a fluid barrier, thus suggesting that leakage across the packer 20 may not be the cause of the absence of the barrier and increasing the confidence that the absence of the barrier is caused by an absence of barrier in the interval 24.

Upon the surface monitor indicating the absence of a barrier between the first fluid volume and the second fluid volume, cement can be injected through a bore in the pipe string 14 while the pipe string 14 remains in the wellbore casing. The cement can remedy the absence of a barrier in the interval 24. The ability to obtain an indicating the absence of a barrier between the first fluid volume and the second fluid volume without having to trip the pipe string 14 out of the wellbore casing 10 and the ability to inject cement with the pipe string 14 can save time.

In some embodiments, the packer 20 can be reset against the wellbore casing 10 at several positions along the wellbore casing 10 while the pipe string 14 remains in the wellbore casing 10. Accordingly, several intervals, such as interval 24, can be tested along the wellbore casing 10 to indicate the presence or absence of a barrier. Optionally, the downhole tool may then be used to cut the wellbore casing at a position selected based on the several indications of presence or absence of a barrier. A cut portion of the casing may then be pulled out of the wellbore.

In some embodiments, an outer casing 46 may surround the wellbore casing 10. Cement may be disposed between the wellbore casing 10 and the outer casing 46. Accordingly, the presence or absence of a fluid barrier in a layer of cement disposed between two wellbore casings can be tested with the system described herein.

Referring to FIG. 3, a pressure curve 34 of pressure data as a function of time measured by the first sensor system 18, and a pressure curve 32 of pressure data as a function of time measured by the second sensor system 16, are shown. In this example, the first sensor system 18 measures pressure in the annulus between the pipe string 14 and the wellbore casing 10, and the second sensor system 16 measures pressure in the bore of the pipe string 14. The pressure curve 34 is above the pressure curve 32 because the first sensor system 18 measures fluid pressure at a higher depth than the second sensor system 16. Also, in this example, the pressurized fluid is injected into the wellbore casing 10 through the annulus between the pipe string 14 and the wellbore casing 10, that is, such as shown in FIG. 2. In order to facilitate the indication of the presence or the absence of barrier with pressure measurements, the bore of the pipe string 14 can be sealed so that the measured pressure may reach hydrostatic equilibrium. In order to facilitate the indication of the presence or the absence of barrier with flow rate measurements (or temperature measurements), the bore of the pipe string 14 can be open so that the measured flow rate may reach stationary equilibrium. Optionally, the bore of the pipe string 14 can be alternately sealed or open, and the indication of the presence or the absence of barrier can be based on pressure measurements and flow rate measurements (or temperature measurements).

The injection of pressurized fluid starts approximately at time 36 and ends approximately at time 40. After time 40, no additional fluid is injected, but the injection port is sealed. Around time 38, the injection port and/or the bore of the pipe string 14 are unsealed, and the trapped pressure is allowed to vent.

The example shown is indicative of an absence of barrier because the pressure in the second fluid volume, i.e., the pressure curve 32 measured by the second sensor system 16, is communicated to the first fluid volume, at the difference of pressure 44 after equilibrium has been reached is close to the pressure difference caused by the difference in depth between the first sensor system 18 and the second sensor system 16.

In the presence of a barrier, the pressure curve 32 measured by the second sensor system 16 would remain flatter.

Accordingly, a program executed on a surface monitor may display the pressure curves 32 and 34 to indicate the presence or the absence of a barrier. Alternatively or additionally, the program may determine the features of the pressure curves 32 and 34, such as the offset before fluid injection, after fluid injection but before venting of the pressure, and after venting of the pressure and display an indication of the presence or the absence of a barrier without displaying the pressure data.

While FIG. 3 shows only pressure measurements, temperature, and flow rate measurements may alternatively or additionally be utilized to indicate the presence or absence of a flow barrier. For example, in the presence of a barrier, a relatively colder pressurized fluid can be injected in the wellbore casing 10, and may replace the relatively warmer fluid present in the first and second fluid volumes. The flow of fluid can also be detected with flow rate sensors irrespectively of the temperatures of the pressurized fluid injected in the wellbore and the fluid present in the wellbore.

While FIG. 3 shows only fluid property measurements performed with the first sensor system 18 and the second sensor system 16, the system can optionally comprise one or more of a surface annular pressure sensor, a surface annular temperature sensor, a surface annular flow rate sensor, a standpipe pressure sensor, a standpipe temperature sensor, a standpipe flow rate sensor, a pump pressure sensor, a pump temperature sensor, or a pump flow rate sensor, which may be coupled to the surface monitor. These sensors can perform fluid property measurements that can be used by the program executed on the surface monitor for indicating the presence or the absence of a barrier in the interval 24 in conjunction with the fluid property measurements performed by the first sensor system 18 and/or the second sensor system 16.

While FIG. 3 illustrates the indication of a barrier that utilizes the injection of pressurized fluid into the wellbore casing, the indication of a barrier can alternatively or additionally rely on the pumping of fluid from the wellbore casing.

Specific embodiments thereof are shown by way of example in the drawings and description. It should be understood, however, that the drawings and detailed description thereto are not intended to limit the claims to the particular form disclosed, but on the contrary, the intention is to cover all modifications, equivalents, and alternatives falling within the scope of the claims.

What is claimed is:

1. A method for indicating a presence or an absence of a barrier in a wellbore casing, the method comprising:

providing a pipe string in the wellbore casing;

setting a packer coupled to the pipe string against the wellbore casing;

injecting fluid into the wellbore casing or pumping fluid from the wellbore casing with a pump;

measuring a fluid property of a first fluid volume located in the wellbore casing below the packer after the packer is set against the wellbore casing, wherein the measuring is performed with a first sensor system coupled to the pipe string in response to the fluid being injected or pumped by the pump;

measuring a fluid property of a second fluid volume located in the wellbore casing above the packer after the packer is set against the wellbore casing, wherein the measuring is performed with a second fluid sensor system coupled to the pipe string in response to the fluid being injected or pumped by the pump;

transmitting fluid property data measured with the first sensor system and with the second sensor system to a surface monitor while the pipe string remains in the wellbore casing, wherein the transmitting is performed with a telemetry; and executing a program on the surface monitor for causing the surface monitor to receive the fluid property data transmitted with the telemetry and indicate a presence or an absence of a barrier behind the wellbore casing between the first fluid volume and the second fluid volume based on the received data.

2. The method of claim 1, wherein the wellbore casing includes a first hole and a second hole offset from the first hole, and wherein the packer is set between the first hole and the second hole.

3. The method of claim 1, wherein an outer casing surrounds the wellbore casing, and wherein cement is disposed between the wellbore casing and the outer casing.

4. The method of claim 1 further comprising resetting the packer against the wellbore casing while the pipe string remains in the wellbore casing.

5. The method of claim 1 further comprising adjusting a setting force on the packer while the pipe string remains in the wellbore casing upon the surface monitor indicating the absence of the barrier between the first fluid volume and the second fluid volume.

6. The method of claim 1 further comprising emitting an acoustic signal that encodes the fluid property data in a wall of the pipe with a transmitter, wherein the acoustic signal is capable of traveling along the pipe string and across the packer, and wherein the transmitting of the fluid property data is performed while the packer remains set against the wellbore casing.

7. The method of claim 1 further comprising conducting an electrical signal that encodes the fluid property data through a section of wired drill pipe, wherein the section of wired drill pipe is disposed across the packer, and wherein the transmitting of the fluid property data is performed while the packer remains set against the wellbore casing.

8. The method of claim 1, wherein the measuring of the fluid property in the first fluid volume is performed with a pressure sensor or a flow rate sensor.

9. The method of claim 8, wherein the measuring of the fluid property in the second fluid volume is performed with a pressure sensor or a flow rate sensor.

10. The method of claim 9, wherein the surface monitor indicates the presence or the absence of the barrier between the first fluid volume and the second fluid volume by comparing a pressure difference measured after hydrostatic equilibrium has been reached to a pressure difference caused by the difference in depth between the first sensor system and the second sensor system.

11. The method of claim 9, wherein the surface monitor indicates the presence or the absence of the barrier between the first fluid volume and the second fluid volume by analyzing pressure offsets before fluid injection, after fluid injection but before venting of the pressure, and after venting of the pressure.

12. The method of claim 1, wherein the injecting of the fluid into the wellbore casing is selectively performed through a bore in the pipe string, through an annulus between the pipe string and the wellbore casing, or alternately through the bore and through the annulus;

wherein the measuring the fluid property in the first fluid volume comprises measuring fluid pressure in the bore of the pipe string with a first sensor and measuring fluid pressure in the annulus of the wellbore casing with a second sensor, wherein the first sensor and the second sensor are both coupled to the pipe string at a first longitudinal location below the packer; and wherein the measuring the fluid property in the second fluid volume comprises measuring fluid pressure in the annulus of the wellbore casing with a third sensor, wherein the third sensor is coupled to the pipe string at a second longitudinal location above the packer.

13. The method of claim 1 further comprising injecting cement through a bore in the pipe string while the pipe string remains in the wellbore casing upon the surface monitor indicating the absence of the barrier between the first fluid volume and the second fluid volume.

14. The method of claim 1 wherein the fluid property data are measured by the first sensor system and by the second sensor system during one or more time intervals between a first time when the pump is started and a second, later time when a pump port is unsealed.

* * * * *